US008904835B2

(12) United States Patent
Böhm et al.

(10) Patent No.: US 8,904,835 B2
(45) Date of Patent: Dec. 9, 2014

(54) DOOR HANDLE ASSEMBLY FOR A VEHICLE

(75) Inventors: Günther Böhm, Walting (DE); Georg Hochholzer, Beilngries (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 13/981,878

(22) PCT Filed: Dec. 17, 2011

(86) PCT No.: PCT/EP2011/006401

§ 371 (c)(1),
(2), (4) Date: Oct. 10, 2013

(87) PCT Pub. No.: WO2012/100803

PCT Pub. Date: Aug. 2, 2012

(65) Prior Publication Data

US 2014/0047877 A1 Feb. 20, 2014

(30) Foreign Application Priority Data

Jan. 26, 2011 (DE) ..... 10 2011 009 524

(51) Int. Cl.

| | |
|---|---|
| ***E05B 13/00*** | (2006.01) |
| ***E05B 17/18*** | (2006.01) |
| ***E05B 47/00*** | (2006.01) |
| ***E05B 83/36*** | (2014.01) |
| ***E05B 81/16*** | (2014.01) |
| ***E05B 85/10*** | (2014.01) |
| ***E05B 85/18*** | (2014.01) |

(52) U.S. Cl.

CPC ..... *E05B 81/16* (2013.01); *E05B 83/36* (2013.01); *E05B 85/107* (2013.01); *E05B 85/18* (2013.01); *E05B 85/103* (2013.01); *Y10S 292/31* (2013.01)

USPC ..... 70/208; 70/210; 70/257; 70/278.7; 70/279.1; 70/423; 70/455; 292/336.3; 292/DIG. 31

(58) Field of Classification Search

CPC ..... E05B 17/14; E05B 17/185; E05B 17/186; E05B 17/002; E05B 17/183; E05B 17/181; E05B 17/16; E05B 17/142; E05B 13/001; E05B 13/00; E05B 17/145; E05B 17/147; E05B 17/18; E05B 17/188

USPC ..... 70/208, 210, 224, 423–428, 455, 257, 70/278.7, 279.1; 292/336.3, DIG. 31

See application file for complete search history.

(56) References Cited

U.S. PATENT DOCUMENTS 2,131,033 A * 9/1938 Barrington et al. ..... 70/208
2,423,937 A * 7/1947 Humer ..... 292/173

(Continued)

FOREIGN PATENT DOCUMENTS

CN 101514596 8/2009
DE 197 31 325 1/1999

(Continued)

OTHER PUBLICATIONS

International Search Report issued by the European Patent Office in International Application PCT/EP2011/006401 on Apr. 11, 2012.

*Primary Examiner* — Lloyd Gall
(74) *Attorney, Agent, or Firm* — Henry M. Feiereisen LLC

(57) ABSTRACT

Door handle assembly (1) for a vehicle, including a door handle (2) for actuating a door lock (6), which can be moved by external power from a level rest position to an exposed operative position, and a lock cylinder (3) placed adjacent to the door handle (2) for locking and unlocking the door lock (6). The lock cylinder (3) can be covered by a cover plate (4) which, when actuated by hand, exposes the lock cylinder (3) and allows switch of the door handle (2) from the rest position to the operative position.

18 Claims, 3 Drawing Sheets

(56) References Cited

U.S. PATENT DOCUMENTS

| | | | | |
|---|---|---|---|---|
| 5,893,282 | A * | 4/1999 | Runge et al. | 70/208 |
| 6,062,614 | A * | 5/2000 | Petzold | 292/336.3 |
| 6,240,755 | B1 * | 6/2001 | Da Silva | 70/423 |
| 7,526,936 | B2 * | 5/2009 | Niskanen et al. | 70/423 |
| 7,568,743 | B2 * | 8/2009 | Villagrasa et al. | 292/336.3 |
| 8,146,393 | B2 * | 4/2012 | Katagiri et al. | 70/208 |
| 8,176,758 | B2 * | 5/2012 | Ramsauer et al. | 70/208 |
| 8,291,732 | B2 * | 10/2012 | Ramsauer et al. | 70/208 |
| 8,359,889 | B2 * | 1/2013 | Katagiri et al. | 70/215 |
| 8,474,290 | B2 * | 7/2013 | Terhaar et al. | 70/92 |
| 8,584,493 | B2 * | 11/2013 | Gorontzi et al. | 70/208 |
| 2003/0019261 | A1 | 1/2003 | Wittwer | |
| 2005/0247085 | A1 * | 11/2005 | Porter | 70/210 |
| 2006/0273088 | A1 | 12/2006 | Burkat et al. | |
| 2007/0193320 | A1 * | 8/2007 | Niskanen et al. | 70/423 |
| 2008/0190157 | A1 * | 8/2008 | Mizuno | 70/455 |
| 2009/0205383 | A1 * | 8/2009 | Katagiri et al. | 70/237 |
| 2010/0107803 | A1 * | 5/2010 | Ramsauer et al. | 74/510 |
| 2010/0162777 | A1 * | 7/2010 | Savant | 70/101 |
| 2010/0242553 | A1 * | 9/2010 | Yang | 70/160 |
| 2011/0016933 | A1 * | 1/2011 | Ramsauer et al. | 70/277 |
| 2012/0128344 | A1 * | 5/2012 | Kwon | 396/429 |
| 2012/0137743 | A1 * | 6/2012 | Katagiri et al. | 70/215 |
| 2012/0205923 | A1 | 8/2012 | Muller et al. | |
| 2012/0205925 | A1 * | 8/2012 | Muller et al. | 292/336.3 |
| 2012/0247161 | A1 | 10/2012 | Muller et al. | |
| 2013/0098123 | A1 * | 4/2013 | Gorontzi et al. | 70/201 |

FOREIGN PATENT DOCUMENTS

| | | | |
|---|---|---|---|
| DE | 298 04 105 | | 8/1999 |
| DE | 199 07 101 | | 8/2000 |
| DE | 101 23 939 | A1 | 1/2003 |
| DE | 103 40 792 | | 4/2005 |
| DE | 10 2004 036 663 | A | 3/2006 |
| DE | 10 2006 023 973 | A1 | 12/2006 |
| DE | 102008019335 | | 10/2008 |
| DE | 102009045873 | | 4/2011 |
| EP | 1 403 453 | A1 | 3/2004 |
| EP | 1 985 784 | | 10/2008 |
| WO | WO 01/75252 | | 10/2001 |
| WO | WO 2004/079137 | A2 | 9/2004 |
| WO | WO 2006/010649 | | 2/2006 |
| WO | WO 2011/047651 | | 4/2011 |
| WO | WO 2011/047653 | | 4/2011 |

* cited by examiner

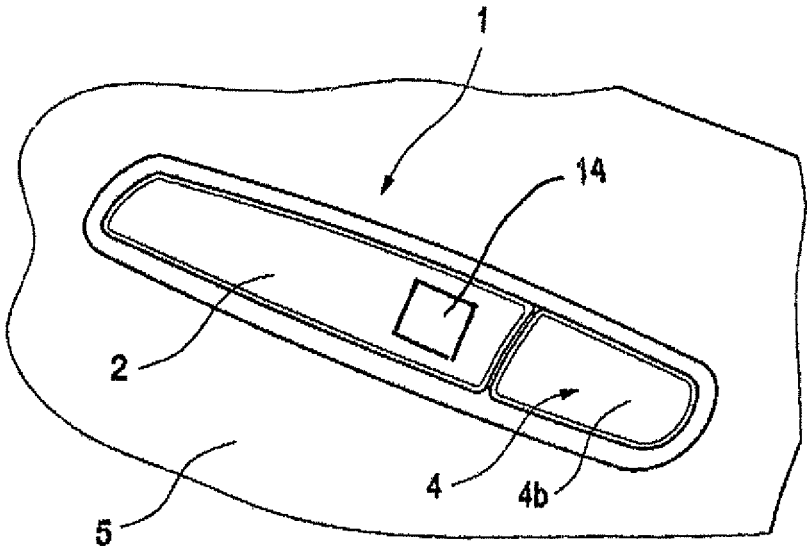
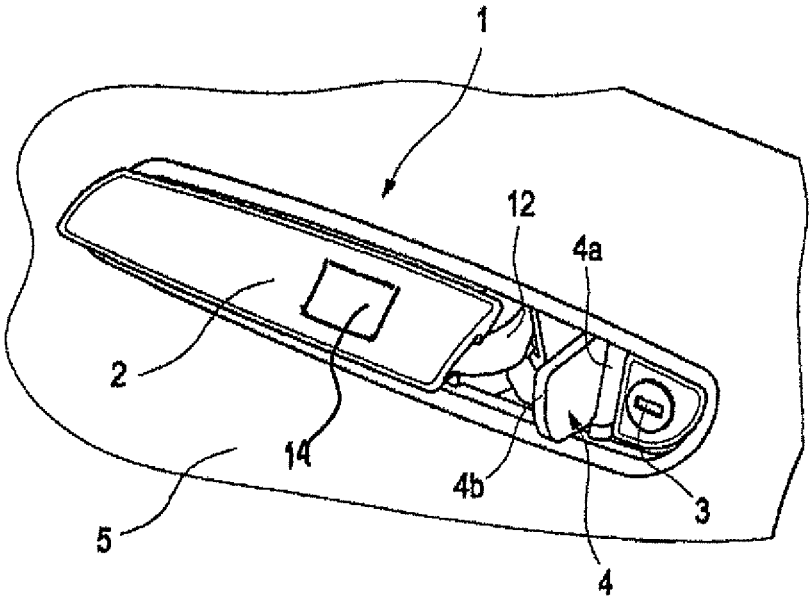
Fig. 2

DOOR HANDLE ASSEMBLY FOR A VEHICLE

CROSS-REFERENCES TO RELATED APPLICATIONS

This application is the U.S. National Stage of International Application No. PCT/EP2011/006401, filed Dec. 17, 2011, which designated the United States and has been published as International Publication No. WO 2012/100803 and which claims the priority of German Patent Application, Serial No. 10 2011 009 524.1, filed Jan. 26, 2011, pursuant to 35 U.S.C. 119(a)-(d).

BACKGROUND OF THE INVENTION.

Door handle assembly for a vehicle, including a door handle for actuating a door lock which can be moved by external power from a level rest position to an exposed operative position, and a lock cylinder placed adjacent to the door handle for locking and unlocking a door lock.

Such door handle assemblies are oftentimes used in vehicles for opening and closing of doors or hatches which are disposed in body openings. A level door handle is to be understood as relating to a door handle having a surface which in the rest position is flush with a surrounding body part. For allowing the door handle to be grasped by a user, the door handle must be moved, preferably by external power, from the rest position to an exposed operative position.

Such a door handle assembly is disclosed in generic DE 197 31 325 A1. The handle piece for opening the door is hereby arranged such that the outside of the handle piece is virtually flush in idle position with the outer contour of the door (level) and the handle piece can be switched for opening the door to an opening position in which the handle piece projects out in relation to the outer contour of the door. An adjuster unit is able to move the handle piece by external power into this opening position. Further arranged adjacent to the handle piece is a cylinder lock which is accessible from outside. The disclosed door handle assembly has the drawback that the cylinder lock cannot be attached in a concealed manner, so that the aesthetic benefits of a level handle piece is hereby partially lost again. This is particularly true in the case of a radio-based user identification that requires a cylinder lock only in exceptional cases. The same applies to the arrangement disclosed in EP 1 985 784 A1.

DE 298 04 105 U1 describes a handle for doors and hatches of motor vehicles, with a handle member which can be pivoted by a motor from a move-in position to a move-out position and has an undergrip zone which is situated in an inaccessible concealed disposition in the move-in position and is accessible only in the move-out position. A lock cylinder for a mechanical key is further provided in the undergrip zone, with the key being insertable only when the handle member is in move-out position. There is the drawback that the handle member can no longer be moved, when the motor drive fails and hence the lock cylinder is no longer reachable.

SUMMARY OF THE INVENTION

It is therefore an object of the present invention to provide a door handle assembly for a vehicle with level door handle and concealed lock cylinder, wherein the door handle can be removed from the level disposition by external power and also by hand.

This object is achieved by a door handle assembly for a vehicle, including a door handle for actuating a door lock, which can be moved by external power from a level rest position to an exposed operative position, and a lock cylinder next to the door handle for locking and unlocking the door lock, wherein the lock cylinder can be covered by a cover plate, exposed by manually operating the cover plate, and the door handle can be moved from the rest position to the operative position.

As the cover plate normally covers the lock cylinder, an aesthetic look is realized when viewed from outside. In this state, the door handle can be moved by a radio-based authorization of the user through external power from a rest position to a operative position and the door lock is unlocked accordingly. The user can thus embrace the door handle and operate the door lock to open the door. After closing the door again, the door handle is returned to the rest position. In the event, the radio-based authorization fails or the operation by external power fails, the cover plate can be operated by hand in an exceptional case so that the lock cylinder is exposed to enable insertion of a mechanical key and the door handle is moved to the operative position at the same time. As a result, even in exceptional cases full functionality of the door handle assembly is provided, and yet a highest degree of aesthetic and aerodynamic advantages is maintained under normal circumstances. Furthermore, it is possible to particularly easily install the door handle assembly because the lock cylinder can easily be inserted and the door handle can be especially easily installed, when the cover plate is actuated. The use of the shown arrangement in doors is equally applicable for hatches in an analogous way. Therefore, in this context, doors are to be understood to also include hatches.

According to a preferred embodiment, the door handle assembly has means for approach detection, with the door handle being movable to the operative position when an authorized user approaches and the door lock is unlocked. These means for approach detection automatically sense the approach of an authorized user and thereby ensure a particularly high level of readiness of the door handle assembly. Such means for approach detection can be configured for example as radio receiver and/or capacitive sensor.

According to a preferred embodiment, the cover plate and the door handle interact via a deflection device. A mechanical deflection device is inexpensive and offers a very high reliability.

According to a preferred embodiment, the door handle can be switched by a deployment lever to the operative position, with a drive and the deflection device engaging on the deployment lever. The combined engagement of the deployment lever by the deflection device and drive decreases the number of parts and allows selective actuation of the deployment lever by hand or external power.

According to preferred embodiment, the drive has a first transmitting member to pull on the deployment lever. Suitable as first transmitting member is a cable pull which engages at a distance from the pivot axis of the deployment lever and pivots the latter. As an alternative, operating rods or a direct connection are possible. Resetting is implemented by spring force.

According to a preferred embodiment, actuation of the door handle is transferable via a second transmitting member to the door lock. A cable pull is especially suitable as second transmitting to transfer the pulling motion of the door handle to the door lock for release thereof.

According to preferred embodiment, the cover plate is swingable about a first pivot axis. The first pivot axis subdivides the cover plate hereby into first and second lever arms, with the first lever arm covering the lock cylinder and the second lever arm interacting with the deflection device. The manual operation of the cover plate is thus effected by applying pressure upon the second lever arm, rendering a particularly power saving operation of the deflection device possible.

According to preferred embodiment, the cover plate includes a flap and a faceplate.

The flap is hereby mounted for pivoting about the first pivot axis and supports the decorative faceplate.

A vehicle has at least a door or hatch including a door handle assembly according to the invention.

BRIEF DESCRIPTION OF THE DRAWING

Further details and advantages of the invention will become apparent from the following description of a preferred embodiment with reference to the drawings.

It is shown in:

FIG. 1 a front view of a door handle assembly in rest position;

FIG. 2 a front view of a door handle assembly in operative position;

Figure 3:
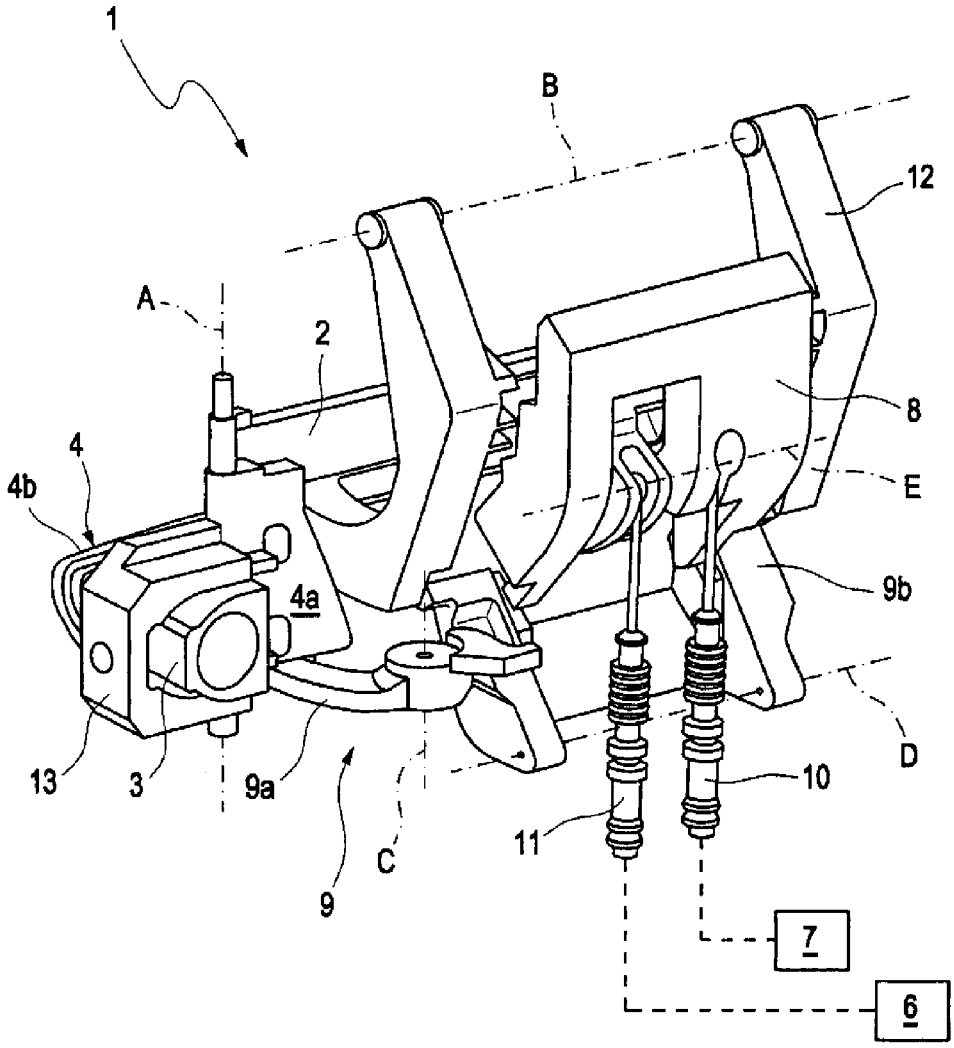
FIG. 3 a rear view of a door handle assembly in rest position.

DETAILED DESCRIPTION OF PREFERRED EMBODIMENTS.

According to FIGS. 1 and 2, a door handle assembly 1 shows, when viewed from outside the vehicle, a level door handle 2 and an adjacent level cover plate 4, comprised of a flap 4*a* and a faceplate 4*b* arranged there above. The surfaces of the door handle 2 and the faceplate 4*b* run in a common plane with the surrounding door 5. The faceplate 4*b* covers the subjacent lock cylinder 3 in normal use, as shown in FIG. 1. In exceptional cases, in particular when moving the door handle 2 from the rest position to the operative position by way of external power fails, the cover plate 4 can be pivoted by hand to expose the lock cylinder 3 and thereby allow insertion of a mechanical key and switch of the door handle 2 at the same time to the operative position, as shown in FIG. 2.

Figure 4:
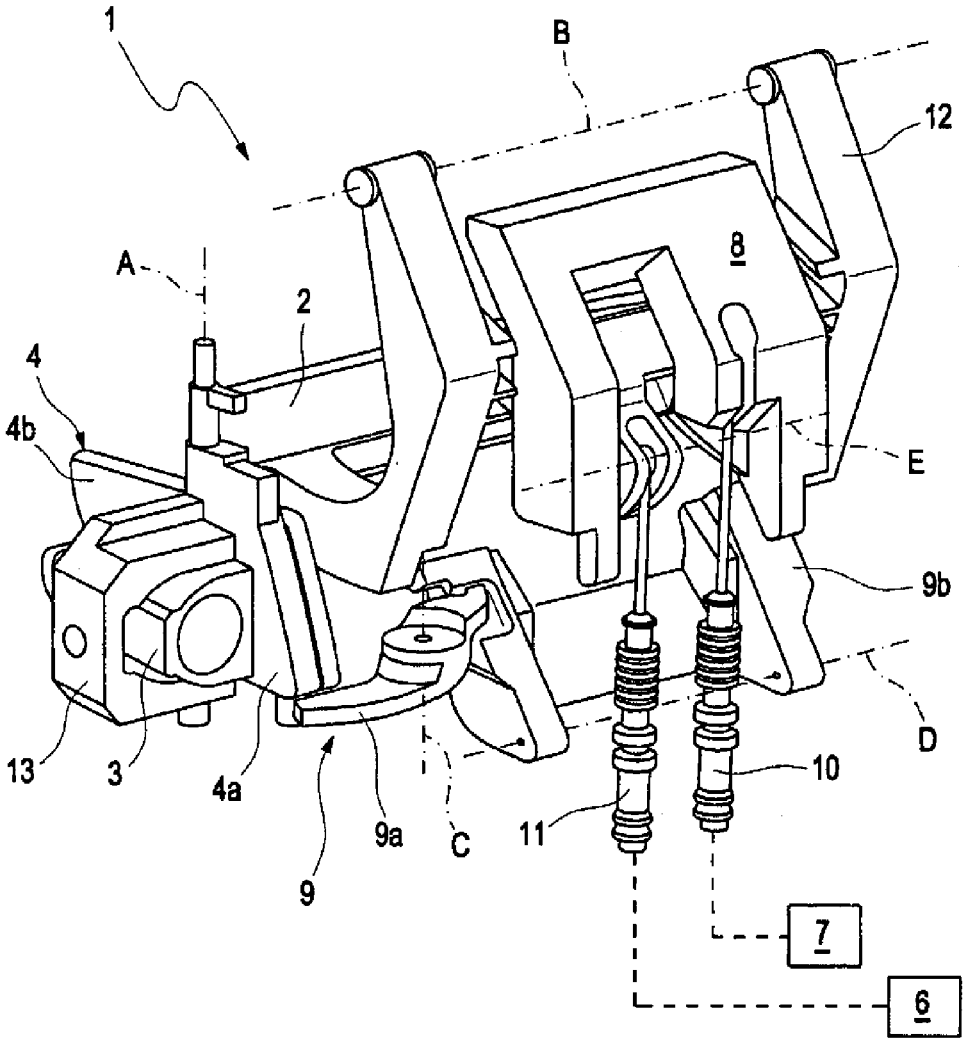
FIG. 4 a rear view of a door handle assembly in operative position.

According to FIGS. 3 and 4, a door handle assembly 1 shows, as viewed from its rear side, a door handle 2 which is carried by a handlebar 12 which is swingable about a second pivot axis B. The handlebar 12 can be pushed from a rest position to an exposed operative position by a deployment lever 8 which is swingable about a fifth pivot axis E. For this purpose, the deployment lever 8 is engaged by a first transmitting member 10 which can be acted upon by a drive 7 with a pulling force. A second transmitting member 11 engages the handlebar 12 to cause actuation of the door lock 6 for opening the door or hatch, when the door handle 2 assumes the operative position (see FIG. 4), Arranged next to the door handle 2 is a lock cylinder 3 which is held by a clip 13. The lock cylinder 3 can be covered by a cover plate 4 which is swingable about a first pivot axis A. The cover plate 4 is comprised of a flap 4*a* which carries a faceplate 4*b*. The faceplate 4*b* covers hereby the lock cylinder 3 and the flap 4*a* is swingably mounted. When the cover plate 4 is rotated by 90° from the normal position shown in FIG. 3, the flap 4*a* acts on a deflection device 9 in such at the door handle 2 is moved to the operative position (see FIG. 4). The flap 4*a* rotates hereby a deflection lever 9*a* about a third pivot axis C, which in turn pushes a manual deployment lever 9*b*, which is swingable about a fourth pivot axis D, against the handlebar 12. The door handle assembly 1 also has an approach detection means or system 14 configured to switch the door handle to the operative position when an authorized user approaches, and to unlock the door lock.

The invention claimed is:

1. A door handle assembly for a vehicle, comprising:

a door lock;

a door handle configured for actuating the door lock and movable by external power without actuating by hand from a level rest position to an exposed operative position;

a lock cylinder adjacent to the door handle for locking and unlocking of the door lock; and a cover plate configured for covering the lock cylinder and, when actuated by hand, exposes the lock cylinder and moves the door handle from the rest position to the operative position at the same time.

2. The door handle assembly of claim 1, further comprising an approach detection system configured to switch the door handle to the operative position, when an authorized user approaches, and to unlock the door lock.

3. The door handle assembly of claim 1, further comprising a deflection device acted upon by the cover plate and switching the door handle to the operative position.

4. The door handle assembly of claim 1, further comprising a deployment lever for switching the door handle to the operative position, with a drive and a first transmitting member engaging the deployment lever and acted upon by the drive.

5. The door handle assembly of claim 4, wherein the drive is in pulling engagement with the deployment lever via the first transmitting member.

6. The door handle assembly of claim 5, further comprising a second transmitting member for transferring actuation of the door handle upon the door lock when the door handle assumes the operative position.

7. The door handle assembly of claim 1, wherein the cover plate is swingable about a first pivot axis.

8. The door handle assembly of claim 7, wherein the cover plate moves the door handle via a deflection device, said first pivot axis subdividing the cover plate into first and second lever arms, with the first lever arm covering the lock cylinder and the second lever arm acting on the deflection device.

9. The door handle assembly of claim 1, wherein the cover plate is comprised of a flap and a faceplate.

10. A vehicle, comprising:

at least one door or hatch; and a door handle assembly for opening and closing the door or hatch, said door handle assembly including a door lock, a door handle configured for actuating the door lock and movable by external power without actuating by hand from a level rest position to an exposed operative position, a lock cylinder adjacent to the door handle for locking and unlocking of the door lock, and a cover plate configured for covering the lock cylinder and, when actuated by hand, exposes the lock cylinder and moves the door handle from the rest position to the operative position at the same time.

11. The vehicle of claim 10, wherein the door handle assembly includes an approach detection system configured to switch the door handle to the operative position, when an authorized user approaches, and to unlock the door lock.

12. The vehicle of claim 10, further comprising a deflection device acted upon by the cover plate and switching the door handle to the operative position.

13. The vehicle of claim 10, further comprising a deployment lever for switching the door handle to the operative position, with a drive and a first transmitting member engaging the deployment lever and acted upon by the drive.

14. The vehicle of claim 13, wherein the drive is in pulling engagement with the deployment lever via the first transmitting member.

15. The vehicle of claim 14, wherein the door handle assembly includes a second transmitting member for transferring actuation of the door handle upon the door lock when the door handle assumes the operative position.

16. The vehicle of claim 10, wherein the cover plate is swingable about a first pivot axis.

17. The vehicle of claim 16, wherein the cover plate moves the door handle via deflection device, said first pivot axis subdividing the cover plate into first and second lever arms, with the first lever arm covering the lock cylinder and the second lever arm acting on the deflection device.

18. The vehicle of claim 10, wherein the cover plate is comprised of a flap and a faceplate.

* * * * *